US006311415B1

(12) United States Patent
Lind

(10) Patent No.: US 6,311,415 B1
(45) Date of Patent: Nov. 6, 2001

(54) BOWLING SHOE WITH REPLACEABLE TIP

(75) Inventor: Jeffrey R. Lind, Somerset, WI (US)

(73) Assignee: Lind Shoe Company, Somerset, WI (US)

( * ) Notice: Subject to any disclaimer, the term of this patent is extended or adjusted under 35 U.S.C. 154(b) by 0 days.

(21) Appl. No.: 09/152,563

(22) Filed: Sep. 14, 1998

(51) Int. Cl.[7] ..... A43B 5/00
(52) U.S. Cl. ..... 36/130; 36/15
(58) Field of Search ..... 36/130, 15, 135, 36/77 R, 73

(56) References Cited

U.S. PATENT DOCUMENTS

| | | | | |
|---|---|---|---|---|
| 638,879 | * | 12/1899 | Packard . | |
| 1,904,886 | * | 4/1933 | Selva . | |
| 1,967,334 | * | 7/1934 | Sothen . | |
| 2,325,741 | * | 8/1943 | Chertok . | |
| 2,640,283 | * | 6/1953 | McCord . | |
| 3,027,661 | * | 4/1962 | McCord . | |
| 3,561,140 | * | 2/1971 | Ludwig . | |
| 3,672,077 | | 6/1972 | Coles | 36/2.5 T |
| 3,693,269 | * | 9/1972 | Guarrera . | |
| 3,903,620 | * | 9/1975 | Gillet . | |
| 4,267,650 | * | 5/1981 | Bauer . | |
| 4,716,664 | | 1/1988 | Taylor | 36/114 |
| 5,542,198 | | 8/1996 | Famolare | 36/130 |

FOREIGN PATENT DOCUMENTS

| | | | |
|---|---|---|---|
| 488133 | * | 9/1918 | (FR) . |
| 21714 | * | 11/1930 | (GB) . |
| 526565 | * | 5/1955 | (IT) . |

* cited by examiner

*Primary Examiner*—Ted Kavanaugh
(74) *Attorney, Agent, or Firm*—Malcolm D. Reid; Cecilia M. Jaisle

(57) ABSTRACT

A bowling shoe with a replaceable tip comprises a shoe upper, a shoe sole mounted to the shoe upper, and a plurality of replaceable shoe tips. The shoe sole has a selectable traction area from a toe end and across the width of the shoe sole. Each tip has a margin substantially equal to a margin of the traction area. Each tip covers and conforms to part of the adjacent shoe upper. The surface of each tip has a different coefficient of friction. A selected tip secures to the traction area and part of the adjacent shoe upper. The tips are interchangeable, to provide traction according to support surface conditions and an individual wearer's preference.

22 Claims, 2 Drawing Sheets

BOWLING SHOE WITH REPLACEABLE TIP

FIELD OF THE INVENTION

The present invention is directed to a shoe fabrication and to a method of providing selectable modification of high or low traction of the shoe on a support surface. In particular, the shoe of this invention is adapted for use as a bowling shoe to allow the wearer, among other features to be later described, control over the slide and/or traction action of each shoe independently.

BACKGROUND OF THE INVENTION

In the game of bowling, accurate approach to the foul line and precise delivery of the ball generally require that the bowler have the ability to control the slide action and the traction action of each foot independently according to individual bowling style and surface conditions of the bowling lane, among other variables. Several attempts have been made to construct bowling shoes with specific designs to the sole, including the toe and/or the heel, to give this element of control according to the individual bowler's preference. Typically, a pair of bowling shoes may include a slide shoe for slide action with a sole of a material with a low coefficient of friction, for example, leather, and a traction shoe for good traction with a sole of a material with a high coefficient of friction., for example, rubber. The traction shoe sole conventionally may have a wear tip at the front of the sole, which may have a low coefficient of friction surface (i.e., a slippery surface) or a high coefficient of friction surface (i.e., a traction surface), according to a bowler's preference, bowling style, and right- or left-handedness. On such a conventional bowling shoe, the sole bottom area covered by the wear tip may become worn with extended use. The worn area typically may include the front edge of the sole and the adjacent shoe upper. The wear may usually arise from two conditions. At the beginning of the approach to the foul line, some bowlers may push off by rolling the traction shoe up onto the toe, sometimes even exaggerating the push off, so that the upper part of the traction shoe may roll up onto the lane surface. Bowlers with this style of approach may generally prefer to have a shoe tip with a high coefficient of friction traction material, such as rubber. Other bowlers, at the end of the approach to the foul line, may slide the traction shoe behind, while sliding forward on the slide shoe. Such bowlers may generally prefer to have a shoe tip with a low coefficient of friction slippery material, such as leather.

Coles, U.S. Pat. No. 3,672,077, issued Jun. 27, 1972, is directed to a shoe which has removable cleats attached to apertures in the sole. Each of the cleats may have a different coefficient of friction, so that by selecting specific cleats, it is said that the bowler may obtain the desired low or high traction characteristics for the sole.

Taylor, U.S. Pat. No. 4,716,664, issued Jan. 5, 1988, describes a bowling shoe which has a specially designed heel and sole surface. The shoe worn on the bowler's sliding foot has a generally U-shaped heel with different outer and inner bottom surfaces. The outer bottom heel surface has a relatively high coefficient of friction as compared to the inner heel surface. The shoe for the non-sliding foot has a sole with a higher coefficient of friction and a conventional uniform heel surface.

Famolare, U.S. Pat. No. 5,542,198, issued Aug. 6, 1996, relates to a bowling shoe, in which the shoe sole has a replaceable slide area on the tread surface. The slide area extends from the toe end of the shoe sole to about the arch portion and extends across the width of the tread surface. The shoe construction includes a removable slide pad which has a peripheral margin about equal to the peripheral margin of the slide area on the tread surface. Mating faces of the slide pad and the tread surface are removably secured to each other by hook and loop fastener material. The heel also has selectively replaceable heels, to provide a desired coefficient of friction to the heel.

Although these and other shoe constructions have been proposed and are currently available, none of them provide all of the advantages of the present invention, including, among other features described herein, selectability of the coefficient of friction of the sole surface and additional protection of the shoe upper adjacent the front sole surface.

BRIEF DESCRIPTION OF THE INVENTION

The present invention is a shoe with a replaceable tip. The shoe comprises a shoe upper, a shoe sole mounted to the shoe upper, and a plurality of replaceable shoe tips. The shoe sole has a selectable traction area which extends from a toe end of the shoe sole and extends across a width of the shoe sole. Each tip has a peripheral margin which is substantially equal to a peripheral margin of the selectable traction area. Each tip also covers and conforms to at least a portion of the shoe upper adjacent to the selectable traction area. Each of the plurality of tips has a different coefficient of friction traction surface. A selected tip of a desired coefficient of friction is removably secured to the selectable traction area and to at least a portion of the adjacent shoe upper. The tips are interchangeable, so that a specific desired coefficient of friction is provided to the selectable traction area according to surface conditions and an individual wearer's preference. The selectable traction area may extend from the toe end of the shoe sole to the ball portion or even to the arch portion. A margin of the shoe sole may extend peripherally outward from the shoe upper to form a sole flange. The selected sole tip may be interiorly provided with a rim which conforms with the toe end of the shoe upper and the extending flange. The sole tip is removably secured between at least a portion of the flange and adjacent shoe upper by this rim. Hook and loop fastener material or adhesive attached to mating faces of the selectable traction area and the tip may removably secure the selected tip to the selectable traction area. The tip may be formed of a material with the pre-determined coefficient of friction. The tip exterior covering the shoe sole may be co-planar with the shoe sole. This shoe with a replaceable tip is suitably adapted for use as a bowling shoe.

In another embodiment, this invention is a shoe for retaining a replaceable shoe tip. The shoe comprises a shoe upper, a shoe sole mounted to the shoe upper, and a selectable traction area. The shoe sole has a selectable traction area which extends from the toe end of the shoe sole and extends across the width of the shoe sole. The shoe is designed and adapted so that one of a plurality of tips can be removably secured to the selectable traction area and to at least a portion of the adjacent shoe upper. The tips are interchangeable and each tip has a different coefficient of friction, so that each tip provides selectable traction according to surface conditions and an individual wearer's preference. The selectable traction area may extend from a toe end of the shoe sole and may extend across a width of the shoe sole. A margin of the shoe sole may extend peripherally outward from the shoe upper to form a sole flange. The selected tip may be provided with an interior rim which conforms between the toe end of the shoe upper and the extended flange, so that the tip can be removably secured to the shoe. A hook and loop fastener material or adhesive may removably secure mating faces of the selected tip to the selectable traction area of the shoe. The selectable traction area may be of reduced thickness compared to the rest of the shoe sole, so that when the selected tip is attached, the exterior of the selected tip is co-planar with the full-thickness body of the shoe sole. The shoe is particularly adaptable for use as a bowling shoe.

According to a further embodiment, this invention is a replaceable shoe tip for a shoe. The tip has a peripheral margin substantially equal to a peripheral margin of a selectable traction area of a shoe sole at the toe end, mounted to a shoe upper. The tip covers and conforms to at least a portion of the shoe upper adjacent to the selectable traction are of the shoe sole. The tip has a pre-determined coefficient of friction traction exterior. The tip is designed and adapted to be removably securable to the selectable traction area and to at least a portion of the adjacent shoe upper. The tip is interchangeable on the shoe with a tip of a different pre-determined coefficient of friction to provide a coefficient of friction to the selectable traction area according to surface conditions and an individual wearer's preference. The selected tip may have an interior rim within the sole tip to conform between a margin of the shoe sole which extends peripherally outward from the shoe upper to form a sole flange. The interior rim allows the tip to be removably secured to the shoe. The selected tip may be removably secured to the selectable traction area by a hook and loop fastener material or by adhesive attached to mating faces of the selectable traction area and the tip. The tip may be formed of a material with the pre-determined coefficient of friction. The tip exterior may be co-planar with the shoe sole. The tip is particularly suitable for use on a bowling shoe.

According to yet another embodiment, this invention is a method of providing selectable traction for a shoe. The method comprises the following steps. Provide a shoe upper. Provide a shoe sole that has a selectable traction area, which extends from a toe end of the shoe sole and extends across a width of the shoe sole. Mount the shoe sole to the shoe upper. Provide a plurality of replaceable tips for removable attachment to the selectable traction area. Construct each tip with a peripheral margin substantially equal to a peripheral margin of the selectable traction area. Design and adapt each tip to cover and conform to at least a portion of the shoe upper adjacent to the selectable traction area. Construct each of the plurality of sole tips with a different pre-determined coefficient of friction traction exterior. Removably secure a selected tip to the selectable traction area and to at least a portion of the adjacent shoe upper. Design and adapt the plurality of tips to be interchangeable to provide a coefficient of friction to the selectable traction are according to bowling lane conditions and an individual bowler's preference. The shoe sole may be constructed with a margin which extends peripherally outward from the shoe upper to form a shoe flange. The selected tip may be removably secured to at least a portion of the shoe upper adjacent to the selectable traction area. The tip may be constructed with an interior rim designed and adapted to conform between the toe end of the shoe upper and the extending flange. The mating faces of the sole tip and the selectable traction area may be provided with hook and loop fastener material or with adhesive to removably secure the selected tip to the selectable traction area and to at least a portion of the adjacent shoe upper, by aligning the mating faces to each other and mating the hook and loop fastener material or the adhesive, respectively, together. The tip may be constructed of a material with the pre-determined coefficient of friction. The tip exterior and the selectable traction area may be constructed to be co-planar.

DETAILED DESCRIPTION OF THE INVENTION

According to the present invention, a replaceable tip is provided to cover a front portion of the sole of a shoe, an adjacent portion of the front of the shoe upper and the intervening area of attachment of the sole to the upper. The shoe may be of the bowling shoe type. The replaceable tip can be made to provide either a high or a low coefficient of friction exterior to provide either slide or traction to the sole exterior, as preferred by the individual wearer, such as a bowler. In conformance with the concept of this invention, a plurality of tips, each of a different coefficient of friction surface, may be easily interchangeable, being attached by such replaceable means as hook and loop fastening material or adhesive.

Figure 1:
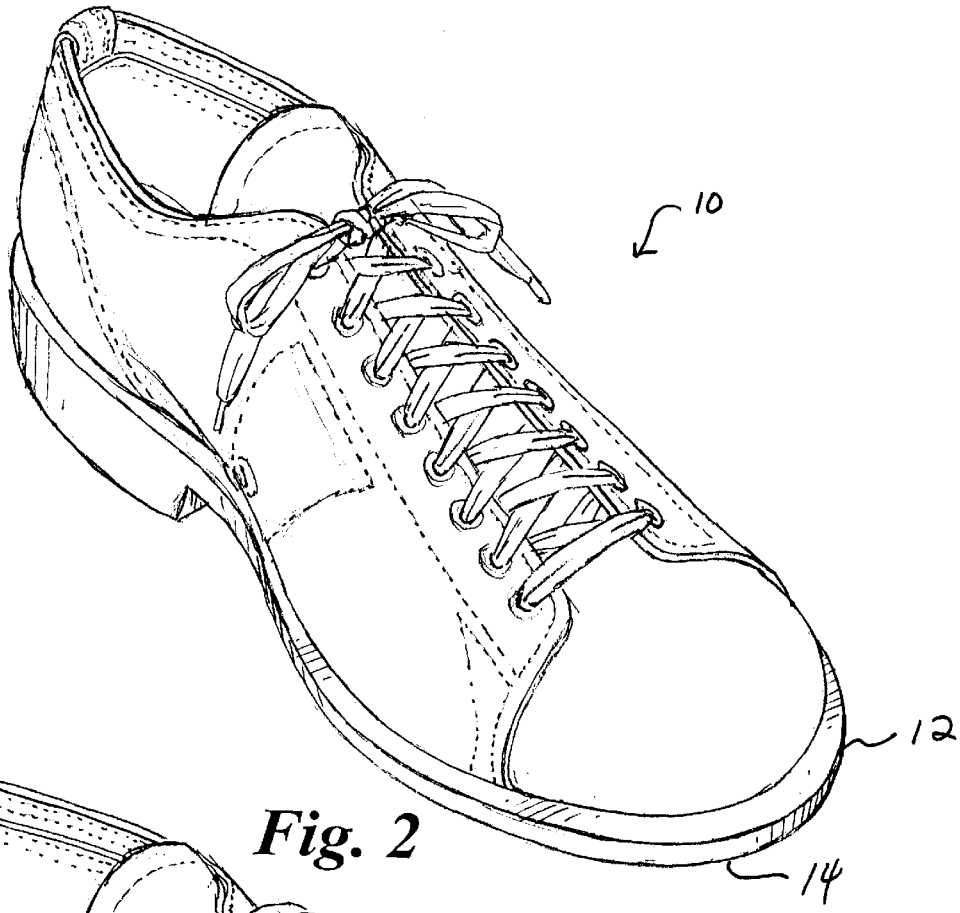
FIG. 1 is a perspective view of the upper of a conventional bowling shoe.

FIG. 1 illustrates a typical shoe 10 of the type designed and adapted for wear in bowling. To provide greater stability and balance for the bowler, the shoe 10 may be constructed with a flange 12 of the sole 14 extending peripherally outward.

Figure 2:
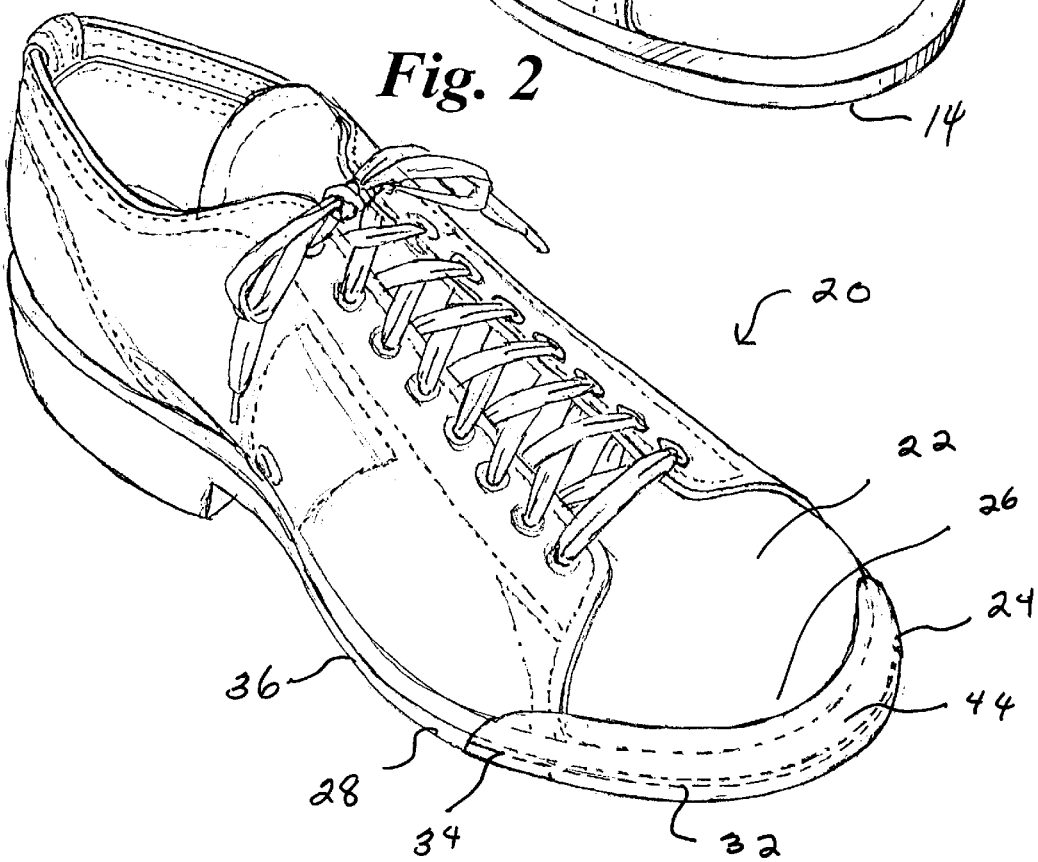
FIG. 2 is a perspective view of the upper of a bowling shoe of this invention, with the replaceable tip installed.
Figure 3:
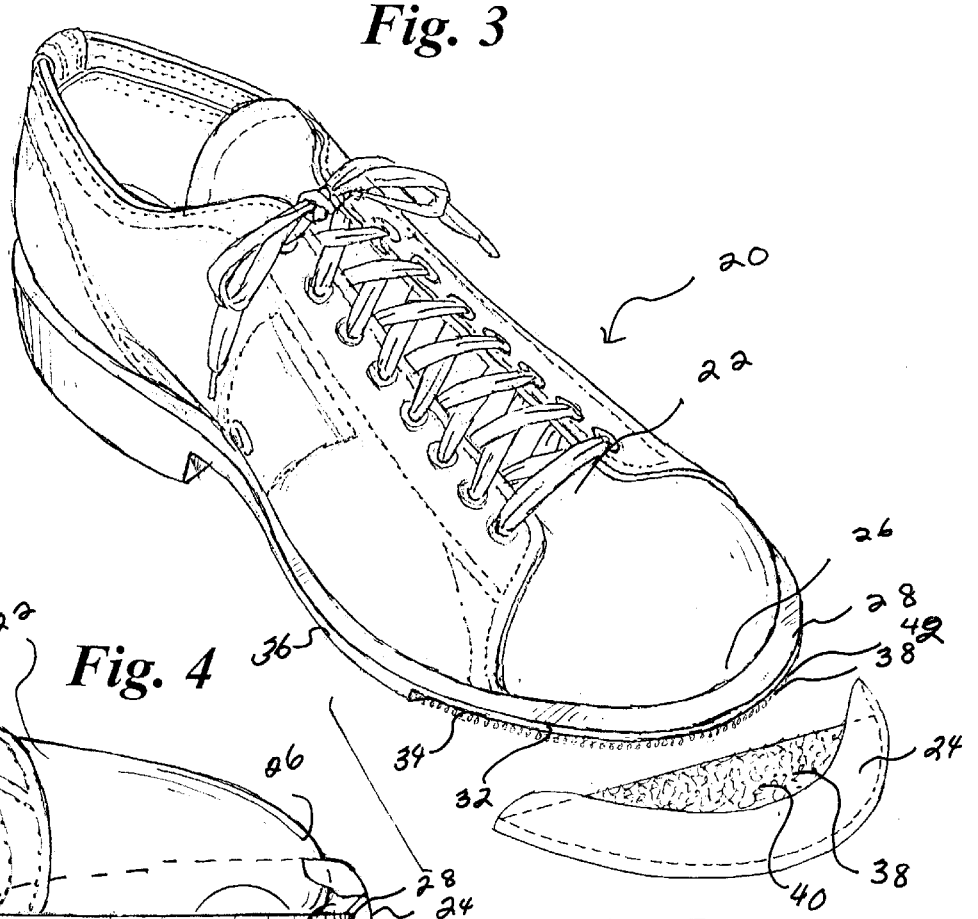
FIG. 3 is a perspective view of the upper of a bowling shoe of this invention, with the replaceable tip in position to be installed, and showing a hook and loop fastening material for attachment.
Figure 4:
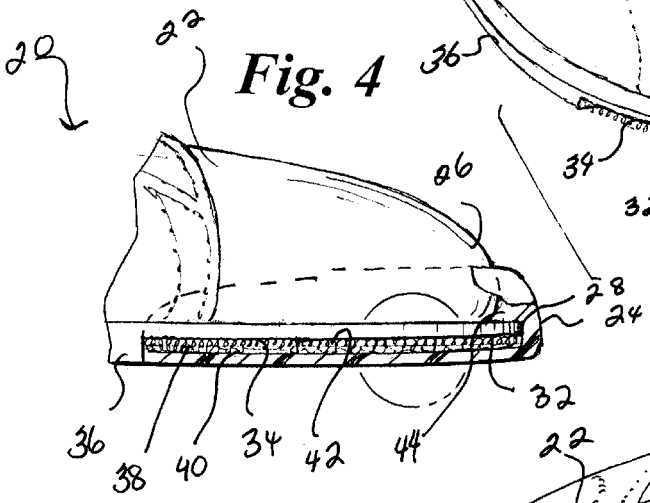
FIG. 4 is a cutaway view of the toe end of the bowling shoe of FIG. 2, with the replaceable tip installed, showing an interior rim on the tip to conform between the toe end of the shoe upper and the extending flange, and showing a hook and loop fastening material for attachment.
Figure 5:
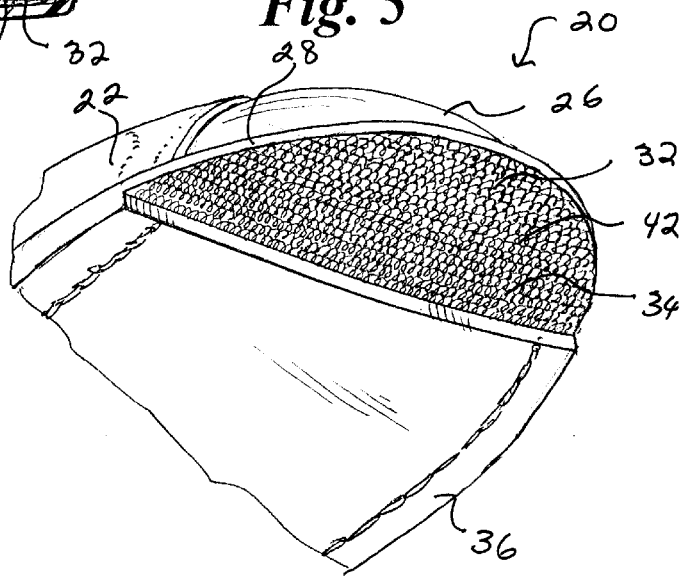
FIG. 5 is a view of the selectable traction area of the sole tip of the bowling shoe of FIG. 3, showing the reduced thickness of the selectable traction area and showing half of the hook and loop fastener material.

An embodiment of a bowling shoe 20 with a replaceable tip 24 according to this invention will now be described, with reference to FIGS. 2–6, which illustrate a bowling shoe 20 incorporating features of the present invention. The construction and materials of the shoe 20 may be standard or customary in the industry to this type of shoe. FIG. 2 is a perspective view of the upper 22 of a bowling shoe 20 of this invention, with the replaceable tip 24 installed. As can be seen in FIG. 2, the tip 24 extends peripherally around the toe 26, covering the flange 28 and extends upward to conform to and protect the adjacent toe 26 end of shoe upper 22. FIG. 3 is a perspective view of the upper 22 of the bowling shoe 20, with the replaceable tip 24 in position to be installed. The front toe portion 32 of the sole 34, as can perhaps be better seen in FIG. 5, is recessed slightly from the full thickness of the body of the sole 36. As can be seen in FIGS. 3 and 5, and in the partially cut-away profile of FIG. 4, the mating faces of the recessed front toe portion 32 of the sole 34 and the replaceable tip 24 are provided with hook and loop fastening material 38 for attachment. As shown in FIGS. 3–5, for example, the loop portion 40 may be attached on the replaceable tip 24 and the hook portion 42 may be attached on the recessed front toe portion 32 of the sole 34, although the opposite configuration would be equally effective. The hook portion 42 and the loop portion 40 may be affixed to the mating face of the tip 24 or the sole 34 by any suitable customary means, such as by adhesive or bonding. As can perhaps best be seen in FIG. 4, by providing a recessed front toe portion 32 of the sole 34 of to slightly less thickness than the body of the sole 36, the exterior surfaces of the replaceable tip 24 and the body of the sole 36 are co-planar. This makes for a firm, secure and comfortable walking surface for the bowling shoe 20, which is vital when approaching the foul line and delivering the ball during bowling.

Figure 6:
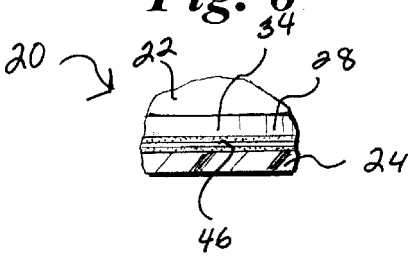
FIG. 6 is a view similar to that of FIG. 4, showing adhesive for attaching mating faces of the replaceable tip and the selectable traction area.

As can also be seen in FIG. 4, the replaceable tip 24 is interiorly provided with a rim 46 to conform between the toe end 26 of the shoe upper 22 and the extending flange 28, in order to more securely locate and attach the replaceable tip 24 to the bowling shoe 20. FIG. 6 is a view similar to that of FIG. 4, but showing an adhesive 46 for attaching the replaceable tip 24 to the recessed front toe portion 32 of the sole 34, instead of the hook and loop fastener material 38. The adhesive 46 may be a fluid product which may be applied to the mating faces of the recessed front toe portion 32 of the sole 34 and the replaceable tip 24 and then the mating surfaces may be firmly and evenly pressed together. Alternatively, the adhesive may be a conventional double-faced adhesive material with treated release paper on each face, which may be cut and sized to match the mating faces of the recessed front toe portion 32 of the sole 34 and the replaceable tip 24. One of the release papers may be removed to firmly affix the double-faced adhesive material to either the recessed front toe portion 32 of the sole 34 or to the replaceable tip 24. The other release paper may then be removed and the remaining portion of either the recessed front toe portion 32 of the sole 34 or the replaceable tip 24 may be attached by firmly and evenly pressing the mating faces together, as shown in FIG. 6.

This invention also is a method of providing selectable traction for a shoe. The method comprises the following steps, in which the identifying numerals refer to the same features illustrated in FIGS. 2–6. A shoe upper 22 is provided. A shoe sole 36 is provided that has a selectable traction area 34. The selectable traction area 34 is constructed to extend from a toe end 32 of the shoe sole 36 and extend across a width of the shoe sole 36. The shoe sole 36 is mounted to the shoe upper 22. A plurality of replaceable tips 24 are provided for removable attachment to the selectable traction area 34. Each tip 24 is constructed with a peripheral margin which is substantially equal to a peripheral margin of the selectable traction area 34. Each tip 24 is designed and adapted to cover and conform between the selectable traction area 34 and at least an adjacent portion of the shoe upper 22. Each of the plurality of sole tips 24 is constructed with a different pre-determined coefficient of friction traction exterior. The specific coefficient of friction traction exterior of each sole tip 24 may be established by the coefficient of friction of the type of material used in constructing the specific tip 24. Alternatively, the coefficient of friction of the exterior of each sole tip 24 may be established by a surface treatment to the sole tip 24, such as a chemical or mechanical treatment, to provide the specific desired surface coefficient of friction.

A selected tip 24 is removably secured to the selectable traction area 34 and to at least a portion of the adjacent shoe upper 22. The plurality of tips 24 are designed and adapted to be interchangeable and to provide a desired coefficient of friction to the selectable traction area 34 according to bowling lane conditions and an individual bowler's preference. To vary the traction or slide characteristics of the shoe 20, the wearer simply removes one tip 24 and replaces it with another tip 24 having a surface of a different coefficient of friction, thereby giving the shoe 24 different traction or slide characteristics, as required by the right- or left-handedness of the wearer, the wearer's preference or characteristics of the surface with which the shoe 20 will be in contact. The shoe sole 36 may be constructed with a margin which extends peripherally outward from the shoe upper 22 to form a shoe flange 28. The selected tip 24 may be removably secured to at least a portion of the shoe upper 22 adjacent to the selectable traction area 34. The interior of the tip 24 may be constructed with an extending rim 44 designed and adapted to conform between the toe end 26 of the shoe upper 22 and the extending flange 28. The mating faces of the sole tip 24 and the selectable traction area 34 may be provided with hook and loop fastener material 38 or with adhesive 46 to removably secure the selected tip 24 to the selectable traction area 34 and to at least a portion of the adjacent shoe upper 22. The mating faces are aligned to each other and mating the hook and loop fastener material 38 or the adhesive 46, respectively, are firmly and securely engaged to each other. The tip 24 may be constructed of a material with the pre-determined coefficient of friction. Non-limiting examples of such materials may include natural materials, such as leather, and rubber, or synthetic materials, such as fabric, synthetic materials, including polymers, such as TEFLON™ and nylon, and laminated materials, in which the basic tip unit may be, for example, molded of a polymer, and the surface material may be any of the previously mentioned materials. In the laminated materials, bonding of the surface material to the basic tip unit may be by any conventional bonding method suitable for affixing the two materials to each other. The tip 24 exterior and the selectable traction area 34 may be constructed to be co-planar, by making the selectable traction area 34 of reduced thickness as compared to the full thickness remaining portion of the sole 36.

The shoe 20 with replaceable tip 24 of this invention is designed to independently provide selectable traction, that is, slide or friction characteristics, to either left or right shoe. Many currently available models of bowling shoes only provide a slide surface to a single shoe of the pair. With such models, inventory must include separate pairs of shoes for both right- and left-handed bowlers. Since the shoe 20 with replaceable tip 24 of this invention may be made with a replaceable tip 24 on both shoes, this will decrease inventory requirements, since either shoe 20 may be the slide or friction shoe, simply by providing the required replaceable tip(s) 24. Thus, it will be possible to market a pair of shoes 20 along with a plurality of tips 24 of generally preferred coefficient of friction characteristics, which may be attached by the individual bowler, according to preference. For the competitive or avid bowler, professional or amateur, it will also be possible to market a pair of shoes 20 without any tips 24 at all, so that the wearer may select from a larger inventory of tips 24 with a wider range of coefficient of friction characteristics to more demanding requirements.

The more casual or beginning bowler typically wears rental bowling shoes that have identical traction surfaces on both shoes, so the right- or left-handedness of the bowler cannot be accommodated. With the shoe 20 with replaceable tip 24 of this invention, rental bowling shoes can be made of more economical materials and still allow for the right- or left-handedness of the individual wearer. This will increase the bowler's control, providing an ability for the casual or beginning bowler to develop greater foot control and to more rapidly increase in skill and enjoyment of the sport.

Also, the replaceable tip 24 will be cost-effective for the rental business, because the useful life of the shoe 20 will be extended by replacing the tip 24 when the front surfaces of the sole and upper are worn.

Although the shoe with replaceable tip of this invention has been described with reference to its suitability as a bowling shoe, there are a wide variety of other situations in which the novel features of this invention would also be useful. Many occupations require extended periods of surface contact of the tip of the shoe upper, including installers of flooring, such as carpet, tile, wood, vinyl, and other floor treatments. In sport or recreational pursuits, certain baseball pitchers have a style of delivering the ball in which they roll up on the tip of the shoe upper of one foot. Mountain climbers often insert or jam the tip of a boot or shoe (including surfaces of both the sole, upper and intervening areas) into a crevice for support in scaling heights. In each of these circumstances, a shoe 20 with a replaceable tip 24, according to the present invention, will provide the advantages of extended shoe wear, because the tip 24 may be replaced when excessively deteriorated, as well as providing selectability of both wear and coefficient of friction characteristics.

Without losing the essential characteristics or spirit of this invention, it may be manifested in other particular forms. The embodiments described are intended only to illustrate the present invention and not to restrict it in any way. The following claims, and not the previous descriptions, define the scope of this invention. The claims include within their range any changes or embodiments within their meaning and scope of equivalency.

That which is claimed is:

1. A replaceable bowling shoe tip for a bowling shoe, the tip having:

a peripheral margin substantially equal to a peripheral margin of a selectable traction area of a shoe sole mounted to a shoe upper, the selectable traction area limited and defined by a permanent sole area covering the shoe sole other than the selectable traction area, the tip designed and adapted to cover and conform to at least a portion of the adjacent shoe upper, the tip having a pre-determined coefficient of friction traction exterior;

the tip having means for removably securing to the selectable traction area and to at least a portion of the adjacent shoe upper; and whereby the tip is interchangeable on the shoe with a tip of a different pre-determined coefficient of friction to provide a coefficient of friction to the selectable traction area according to surface conditions and an individual bowler's preference.

2. A replaceable bowling shoe tip according to claim 1, wherein the means for removably securing the selected tip to at least a portion of the adjacent shoe upper is a rim interiorly provided within the sole tip designed and adapted to conform between a margin of the shoe sole which extends peripherally outward from the shoe upper to form a sole flange and the adjacent shoe upper.

3. A replaceable bowling shoe tip according to claim 1, wherein the means for removably securing the sole tip to the selectable traction area comprises hook and loop fastener material attached to mating faces of the selectable traction area and the tip.

4. A replaceable bowling shoe tip according to claim 1, wherein the means for removably securing the tip to the selectable traction area comprises adhesive between mating faces of the selectable traction area and the tip.

5. A replaceable bowling shoe tip according to claim 1, wherein the tip is formed of a material with the pre-determined coefficient of friction, selected from natural materials, synthetic materials, and laminated materials.

6. A replaceable bowling shoe tip according to claim 1, wherein the tip exterior covering the shoe sole is co-planar with the permanent shoe sole area.

7. A pair of replaceable bowling shoe tips according to claim 1, wherein the tips may be of the same or different coefficient of friction.

8. A method of providing a selectable traction surface for a bowling shoe comprising:

providing a bowling shoe upper;

providing a bowling shoe sole having a selectable traction area extending from a toe end of the shoe sole and extending across a width of the shoe sole and a permanent sole area covering the shoe sole other than the selectable traction area;

mounting the shoe sole to the shoe upper;

providing a plurality of bowling shoe tips, each tip constructed with a peripheral margin substantially equal to a peripheral margin of the selectable traction area and each tip designed and adapted to cover and conform to at least a portion of the adjacent shoe upper, each of the plurality of sole tips constructed with a different pre-determined coefficient of friction traction exterior; and removably securing a selected tip to the selectable traction area and to at least a portion of the adjacent shoe upper, the plurality of tips being interchangeable to provide a coefficient of friction to the selectable traction area according to surface conditions and an individual bowler's preference.

9. A method according to claim 8, wherein the shoe sole is constructed with a margin which extends peripherally outward from the shoe upper to form a shoe flange, and wherein removably securing the selected tip to at least a portion of the adjacent shoe upper comprises constructing a tip with an interior rim designed and adapted to conform between the toe end of the shoe upper and the extending flange.

10. A method according to claim 8, wherein mating faces of the sole tip and the selectable traction area are provided with hook and loop fastener material and wherein removably securing the selected tip to the selectable traction area and to at least a portion of the adjacent shoe upper comprises aligning the mating faces to each other and mating the hook and loop fastener material.

11. A method according to claim 8, wherein mating faces of the tip and the selectable traction area are provided with adhesive therebetween and wherein removably securing the selected tip to the selectable traction area and to at least a portion of the adjacent shoe upper comprises aligning the mating faces to each other and mating the adhesive thereto.

12. A method according to claim 8, wherein the tip is constructed of a material with the pre-determined coefficient of friction, selected from natural materials, synthetic materials, and laminated materials.

13. A method according to claim 8, wherein the tip exterior and the permanent shoe sole area are constructed to be co-planar.

14. A method of providing a selectable traction surface for a pair of bowling shoes according to claim 8, wherein the tips may have the same or different coefficients of friction.

15. A bowling shoe with a replaceable bowling shoe tip comprising:

a bowling shoe upper;

a bowling shoe sole mounted to the shoe upper, the shoe sole having a selectable traction area extending from a toe end of the shoe sole and extending across a width of the shoe sole and a permanent sole area covering the shoe sole other than the selectable traction area;

a selected one of a plurality of bowling shoe tips, each tip having a peripheral margin substantially equal to a peripheral margin of the selectable traction area and each tip covering and conforming to at least a portion of a toe end of the shoe upper, each of the plurality of tips having a different coefficient of friction traction exterior; and means for removably securing the selected tip to the selectable traction area and to at least a portion of the adjacent shoe upper, and whereby the plurality of tips are interchangeable to provide a coefficient of friction to the selectable traction area according to surface conditions and an individual bowler's preference.

16. A bowling shoe according to claim 15, wherein the selectable traction area extends from the toe end of the shoe sole to at least a ball portion.

17. A bowling shoe according to claim 15, wherein a margin of the shoe sole extends peripherally outward from the shoe upper to form a sole flange, and wherein the means for removably securing the selected sole tip to at least a portion of the adjacent shoe upper is a rim interiorly provided within the tip to conform between the toe end of the shoe upper and the extending flange.

18. A bowling shoe according to claim 15, wherein the means for removably securing a selected tip to the selectable traction area comprises hook and loop fastener material attached to mating faces of the selectable traction area and the tip.

19. A bowling shoe according to claim 15, wherein the means for removably securing a selected tip to the selectable traction area comprises adhesive attached between mating faces of the selectable traction area and the tip.

20. A bowling shoe according to claim 15, wherein the tip is formed of a material with the predetermined coefficient of friction, selected from natural materials, synthetic materials, and laminated materials.

21. A bowling shoe according to claim 15, wherein the tip exterior covering the sole is co-planar with the permanent shoe sole area.

22. A pair of bowling shoes, each of which is a shoe according to claim 15, and wherein the selected tip for each shoe may be of the same or different coefficient of friction.

* * * * *